US005480375A

United States Patent [19]

La Fosse et al.

[11] Patent Number: 5,480,375

[45] Date of Patent: Jan. 2, 1996

[54] PAIN RELIEVING ADJUSTABLE LEG SUPPORT

[76] Inventors: Hector M. La Fosse, 411 E. 135th St. #2F, Bronx, N.Y. 10454; George Spector, 233 Broadway Rm. 702, New York, N.Y. 10279

[21] Appl. No.: 260,244

[22] Filed: Jun. 14, 1994

[51] Int. Cl.[6] ..... A61H 1/02

[52] U.S. Cl. ..... 601/23; 601/35; 482/95; 482/144; 482/907

[58] Field of Search ..... 482/91, 95, 96, 482/131, 143, 144, 904, 907; 601/33, 34, 35; 602/34; 606/241; 5/88.1

[56] References Cited

U.S. PATENT DOCUMENTS

| | | | |
|---|---|---|---|
| 2,183,265 | 12/1939 | Maloney | 482/95 |
| 3,887,038 | 6/1975 | Buschbom et al. | 187/259 |
| 4,489,713 | 12/1984 | Latenser | 602/34 |
| 4,492,373 | 1/1985 | Dzitzer | 482/143 |
| 4,531,514 | 7/1985 | McDonald et al. | 482/144 |
| 4,574,789 | 3/1986 | Forster | 482/144 |
| 4,602,618 | 7/1986 | Berzé | 601/33 |
| 5,024,433 | 6/1991 | Mosberg | 482/96 |

*Primary Examiner*—Richard J. Apley
*Assistant Examiner*—Jeanne M. Clark

[57] ABSTRACT

An apparatus to relieve back and leg pain comprising a housing with fasteners for mounting the housing to a ceiling. A pair of cable lines extend downwardly from the housing, while a foot support is affixed to the lower ends of the cable lines. A mechanism is for controlling the vertical movement of the foot support by raising and lowering the cable lines. A person can lie down on their back upon a horizontal surface under the ceiling adjacent the foot support and place their feet upon the foot support when lowered. The foot support can be raised to assist in easing the back and leg pain the person is suffering from.

2 Claims, 1 Drawing Sheet

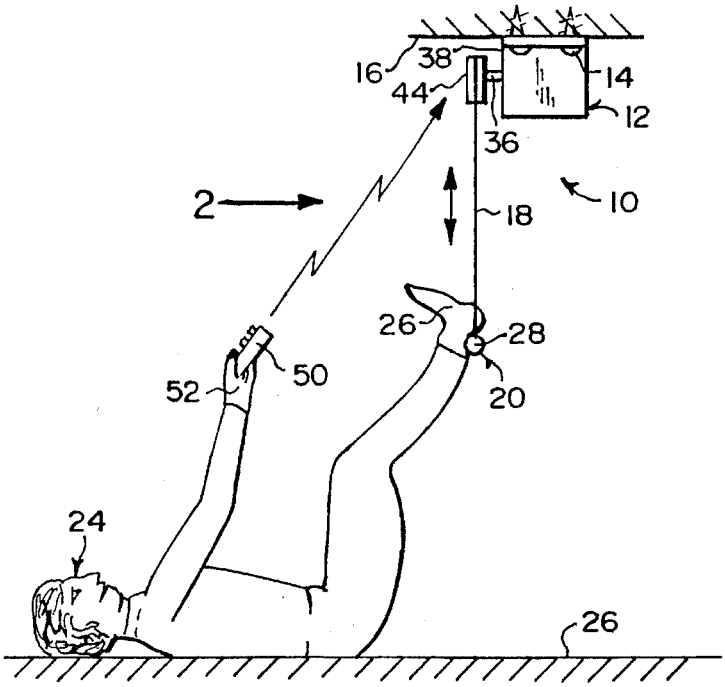
Fig. 1
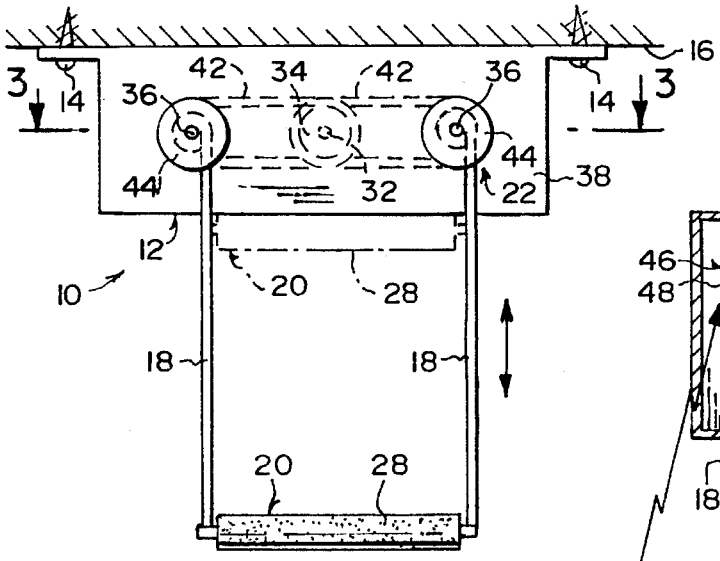
Fig. 2
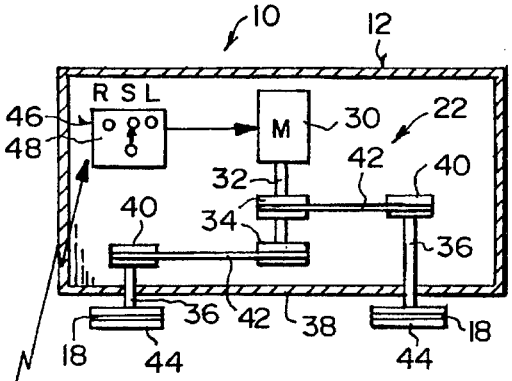
Fig. 3
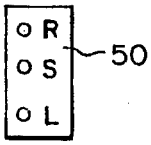

PAIN RELIEVING ADJUSTABLE LEG SUPPORT

BACKGROUND OF THE INVENTION

The instant invention relates generally to medical orthopedic devices and more specifically it relates to an apparatus to relieve back and leg pain, which provides a mechanism to raise the legs of a person, while on their back for easing the back and leg pain.

There are available various conventional medical orthopedic devices which do not provide the novel improvements of the invention herein disclosed.

SUMMARY OF THE INVENTION

A primary object of the present invention is to provide an apparatus to relieve back and leg pain that will overcome the shortcomings of the prior art devices.

Another object is to provide an apparatus to relieve back and leg pain, in which a mechanism is used to raise the legs of a person while they are lying on their back, so as to assist in easing the back and leg pain they may be suffering.

An additional object is to provide an apparatus to relieve back and leg pain, in which the person uses a remote control to operate the mechanism to raise and lower a foot support cushioned rod to a height that is comfortable, thereby enabling back and leg pain to diminish.

A further object is to provide an apparatus to relieve back and leg pain that is simple and easy to use.

A still further object is to provide an apparatus to relieve back and leg pain that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a side view of the instant invention in use.

FIG. 2 is a front view taken in the direction of arrow 2 in FIG. 1.

FIG. 3 is a cross sectional view taken along line 3—3 in FIG. 2, showing the internal mechanism within the housing working in conjunction with the remote control.

DETAILED DESCRIPTION OF THE PREFERRED EMBODIMENTS

Turning now descriptively to the drawings, in which similar reference characters denote similar elements throughout the several views, FIGS. 1 through 3 illustrate an apparatus 10 to relieve back and leg pain comprising a housing 12 with fasteners 14, for mounting the housing 12 to a ceiling 16. A pair of cable lines 18 extend downwardly from the housing 12, while a foot support 20 is affixed to the lower ends of said cable lines 18. A mechanism 22 is for controlling the vertical movement of the foot support 20 by raising and lowering the cable lines 18. A person can lie down on their back upon a horizontal surface 26 under the ceiling 16 adjacent the foot support 20 and place their feet 26 upon the foot support 20 when lowered. Then the foot support 20 can be raised to assist in easing the back and leg pain the person 24 is suffering from.

The foot support 20 is a cushioned rod 28 attached at opposite ends to the lower ends of the cable lines 18 to be suspended thereon in a horizontal position.

The controlling mechanism includes a reversible electric motor 30 in the housing 12, having a drive shaft 32 extending horizontally therefrom within the housing 12. A pair of spaced apart drive pulleys 34 are mounted on the drive shaft 32. A pair of driven shafts 36 in the housing 12 extend horizontally through a front wall 38 of the housing 12. A pair of driven pulleys 40 are provided, with each mounted on an inner end of each driven shaft 36 within the housing 12. A pair of continuous belts 42 are provided, with each extending about one said drive pulley 34 and one driven pulley 40. A pair of spools 44 are also provided, with each mounted on an outer end of each driven shaft 36 with the upper ends of said cable lines 18 wound about the spools 44. A three way switch 46 electrically connected to said electric motor 30 to control the operation of the electric motor 30, to raise and lower the cushioned rod 28 of the foot support 20.

The controlling mechanism 22 further contains the three way switch 46 being a radio activated unit 48. A remote control 50 is held in the hand 52 of the person 24, to operate the radio activated unit 48 of the three way switch 46, so that the person 24 can control the electric motor 30 from a distance.

OPERATION OF THE INVENTION

To use the apparatus 10, the person 24 simply lies upon the horizontal surface 26 under the ceiling 16 adjacent the foot support 20. The remote control 50 is grasped by the hand 52 of the person 24 and operated to lower the foot support 20 downward. The feet 26 are then placed upon the foot support 20. The remote control 50 is then operated again to raise the foot support 20 upward. This will ease the back and leg pain of the person 24.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An apparatus to relieve back and leg pain comprising:

a) a housing;

b) fasteners for mounting said housing to a ceiling;

c) a pair of cable lines extending downwardly from said housing;

d) a foot support affixed to the lower ends of said cable lines;

e) means within said housing for controlling the vertical movement of said foot support by raising and lowering said cable lines, so that the person can lie down on their back upon a horizontal surface under the ceiling adjacent said foot support and place their feet upon said foot support when lowered and then said foot support can be raised to assist in easing the back .and leg pain the person is suffering from; wherein said foot support is a cushioned rod attached at opposite ends to the lower ends of said cable lines to be suspended thereon in a horizontal position; wherein said controlling means includes:

f) a reversible electric motor in said housing, having a drive shaft extending horizontally therefrom within said housing;

g) a pair of spaced, apart drive pulleys-mounted on said drive shaft;

h) a pair of driven shafts in said housing extending horizontally through a front wall of said housing;

i) a pair of driven pulleys, each mounted on an inner end of each said driven shaft within said housing;

j) a pair of continuous belts, each extending about one said drive pulley and one said driven pulley;

k) a pair of spools, each mounted on an outer end of each said driven shaft with the upper ends of said cable lines wound about said spools and l) a three way switch electrically connected to said electric motor to control the operation of said electric motor, to raise and lower said cushioned rod of said foot support.

2. An apparatus to relieve back and leg pains as recited in claim 1, wherein said controlling means further includes:

a) said three way switch being a radio activated unit and b) a remote control held in the hand of the person to operate said radio activated unit of said three way switch, so that the person can control said electric motor from a distance.

* * * * *